United States Patent [19]

Lin

[11] Patent Number: 4,820,330

[45] Date of Patent: Apr. 11, 1989

[54] STRUCTURE FOR CONTROLLING THE DEAD BOLT USED IN AN ELECTRONIC LOCK

[75] Inventor: Jui-Chang Lin, Kaohsiung, Taiwan

[73] Assignees: Jeun-Kuen Lee, Taipei, Taiwan; In-Jyh Liou

[21] Appl. No.: 79,418

[22] Filed: Jul. 30, 1987

[51] Int. Cl.[4] ..... E05B 47/00

[52] U.S. Cl. ..... 70/277; 70/278; 70/224

[58] Field of Search ..... 70/277, 279, 278, 224; 340/825.31, 825.3; 307/10 AT; 235/382.5

[56] References Cited

U.S. PATENT DOCUMENTS

| | | | |
|---|---|---|---|
| 3,894,417 | 7/1975 | Tanijiama | 70/277 |
| 4,051,548 | 9/1977 | Hamada | 70/278 |
| 4,148,092 | 4/1979 | Martin | 70/278 |
| 4,177,657 | 12/1979 | Aydin | 70/278 |
| 4,616,491 | 10/1986 | Genest | 70/278 |

*Primary Examiner*—Robert L. Wolfe

*Attorney, Agent, or Firm*—Larson and Taylor

[57] ABSTRACT

A kind of controlling structure for an electronic lock. The condition that a control plate in an electronic lock is adjusted to the position of "closed" or to that of "open" enables the outside knob either to turn idle or to turn only one time to cause the dead bolt tip of the dead bolt pulled back to unlock the lock.

17 Claims, 8 Drawing Sheets

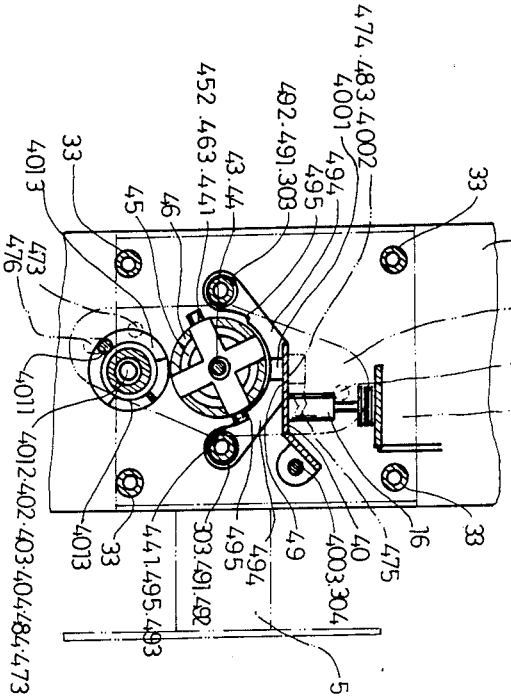
FIG. 7
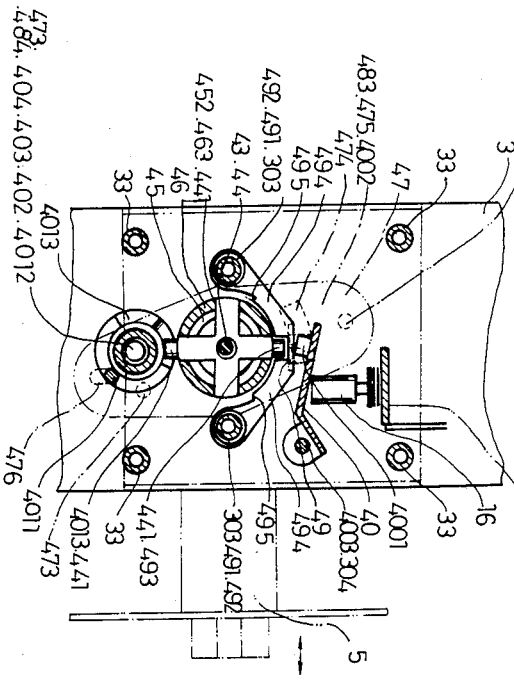
FIG. 8
FIG. 11
FIG. 12

STRUCTURE FOR CONTROLLING THE DEAD BOLT USED IN AN ELECTRONIC LOCK

BACKGROUND OF THE INVENTION

The use of an electronic lock has been growing more and more in locking doors-because its action is more accruate than other locks, and it is more difficult to break it. Opening an electronic lock requires the use of a special card which has an invisible coded number on it, which card is to be checked by the lock to determine whether the coded number is the right one for the lock before opening. At the same time, it can also be controlled in its use combined with a computer system. Therefore, it is more suitable for a large building like a hospital, a large hotel, but not so convenient for a common living house.

SUMMARY OF THE INVENTION

This invention, a structure for controlling the dead bolt used in an electronic lock, provides a structure that enables an electronic lock to function not only as an electronic lock using a coded card but also as a common lock with the electronic part temporarily stopped.

The basic function of this structure is as follows.

1. When the pin of the control plate is moved to the position of "closed", turning the inside knob can open this lock without using a coded card, but turning the outside knob cannot open this lock without the coded card.

2. When the pin of the control plate is moved to the position of "open", turning either the inside knob or the outside one can open this lock freely and repeatedly without using the coded card.

The main characteristic of this structure is the function described in item 2, and it means this lock can function as a common lock with the electronic part temporarily stopped.

BRIEF DESCRIPTION OF THE DRAWINGS

FIGS. 2-1 and 2-2 are exploded perspective views of this invention.

FIG. 7 is an actional view 3 of the moving base, the blocking plate and the rail in this invention.

FIG. 8 is an actional view 4 of the moving base, the blocking plate and the rail in this invention.

FIG. 11 is a cross-sectional view of 11—11 line on FIG. 7.

FIG. 12 is a cross-sectional view of 12—12 line of FIG. 8.

DETAILED DESCRIPTION OF THE INVENTION

Figure 1:
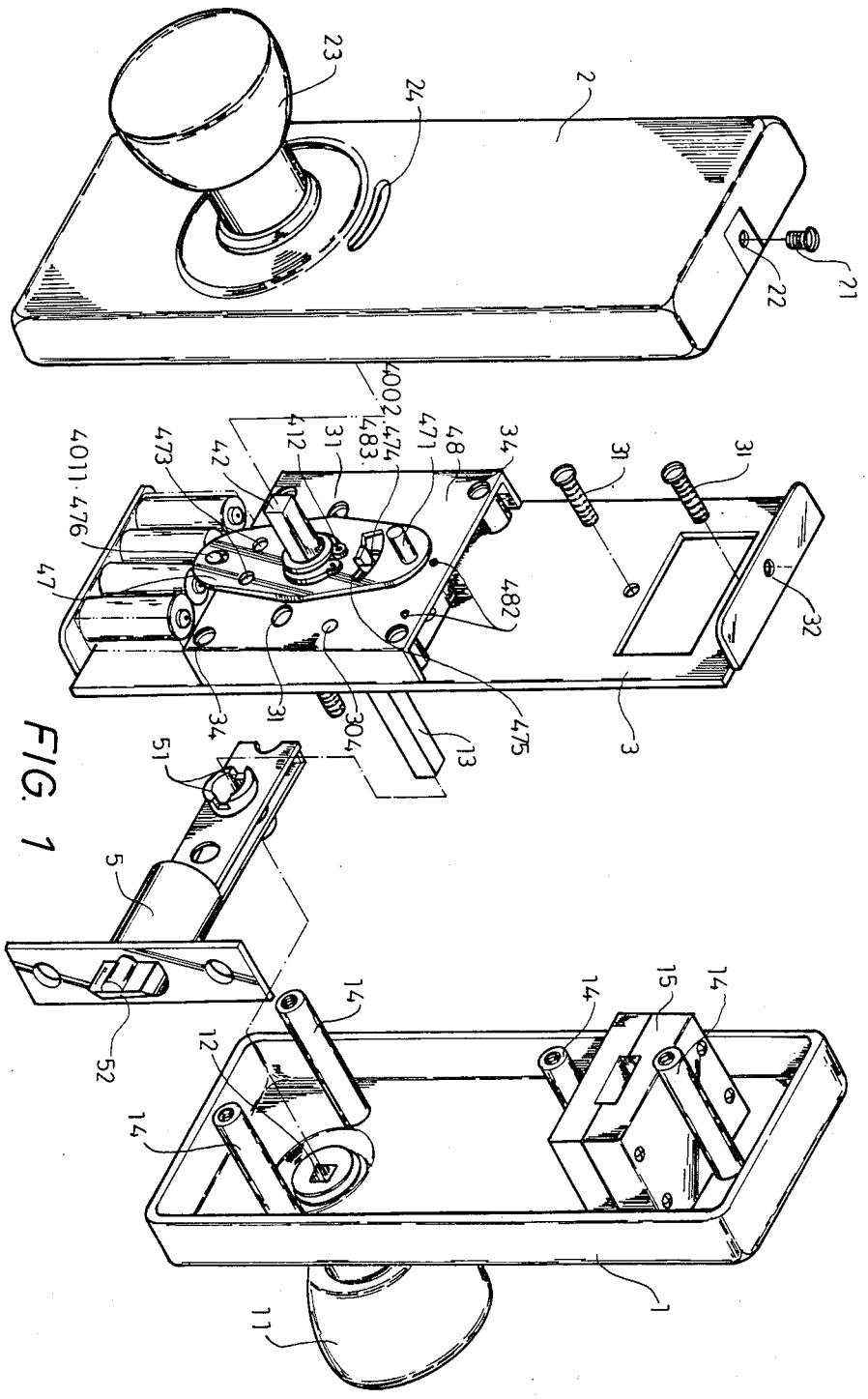
FIG. 1 is a general view of this invention.
Figure 2:
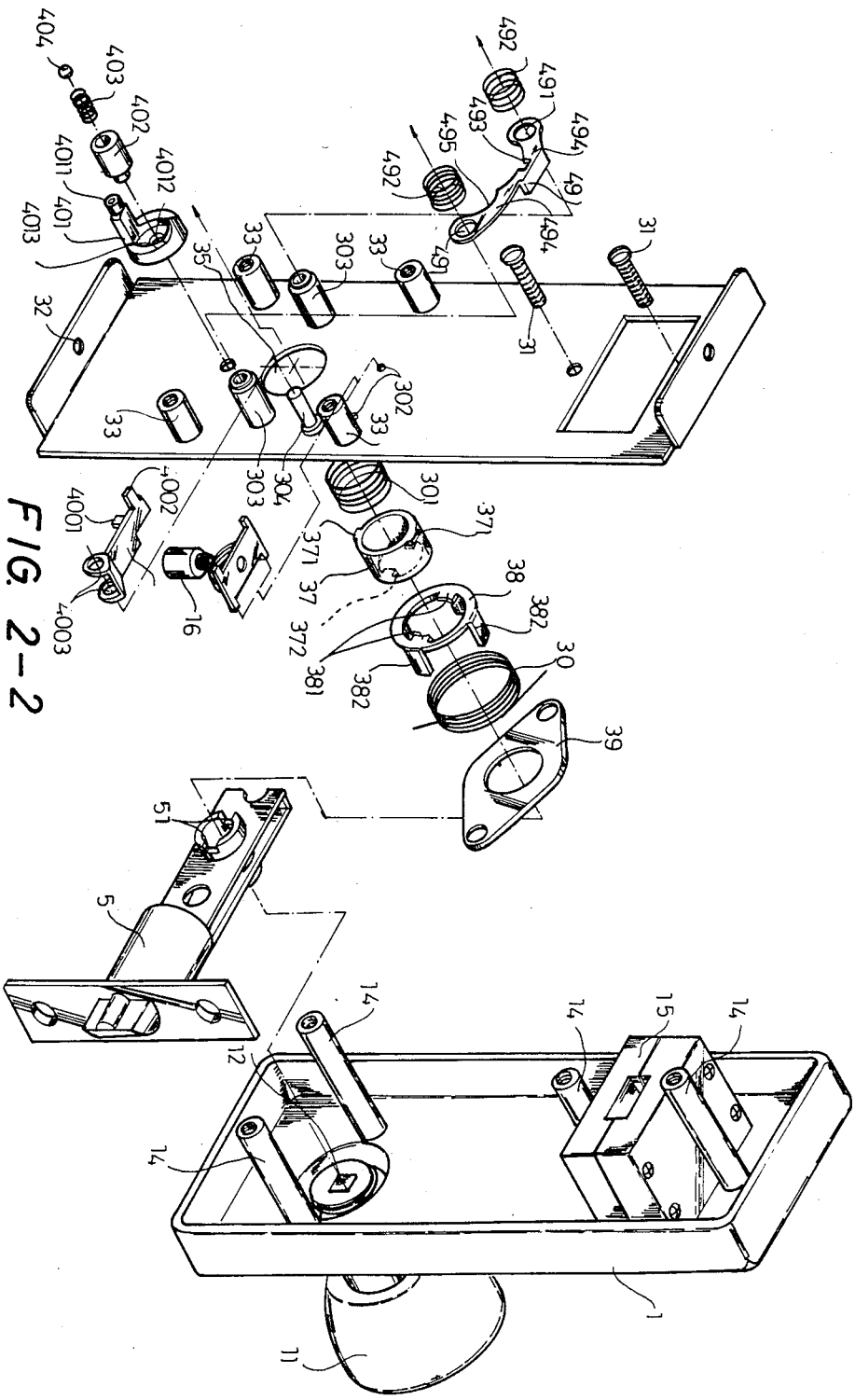

First, as FIG. 1 shows, this invention includes outside cover 1, inside cover 2, base plate 3, moving parts 4 and dead bolt 5 as its main parts.

Outside cover 1 includes turning knob 11 with square shaft hole 12 for square shaft 13 to combine with and to turn together, and four shaft posts 14 for screws 31 to screw in through base plate 3 steadying said plate 3 and outside cover 1 separately on the inside and the outside of the door. At the upper part of outside cover 1 is fixed sensor 15 which checks a coded number card judging the correctness of the coded number to trigger magnetic coil 16 for work.

Figure 3:
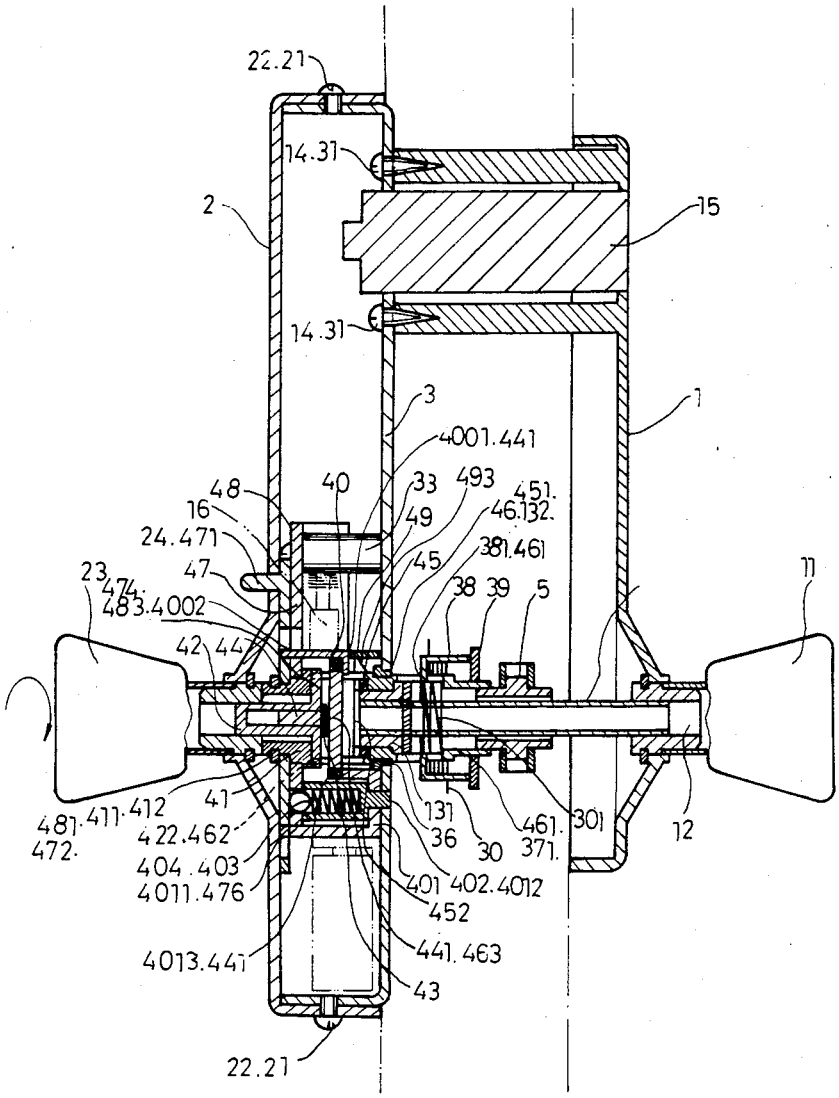
FIG. 3 is a cross-sectional view of this invention.
Figure 4:
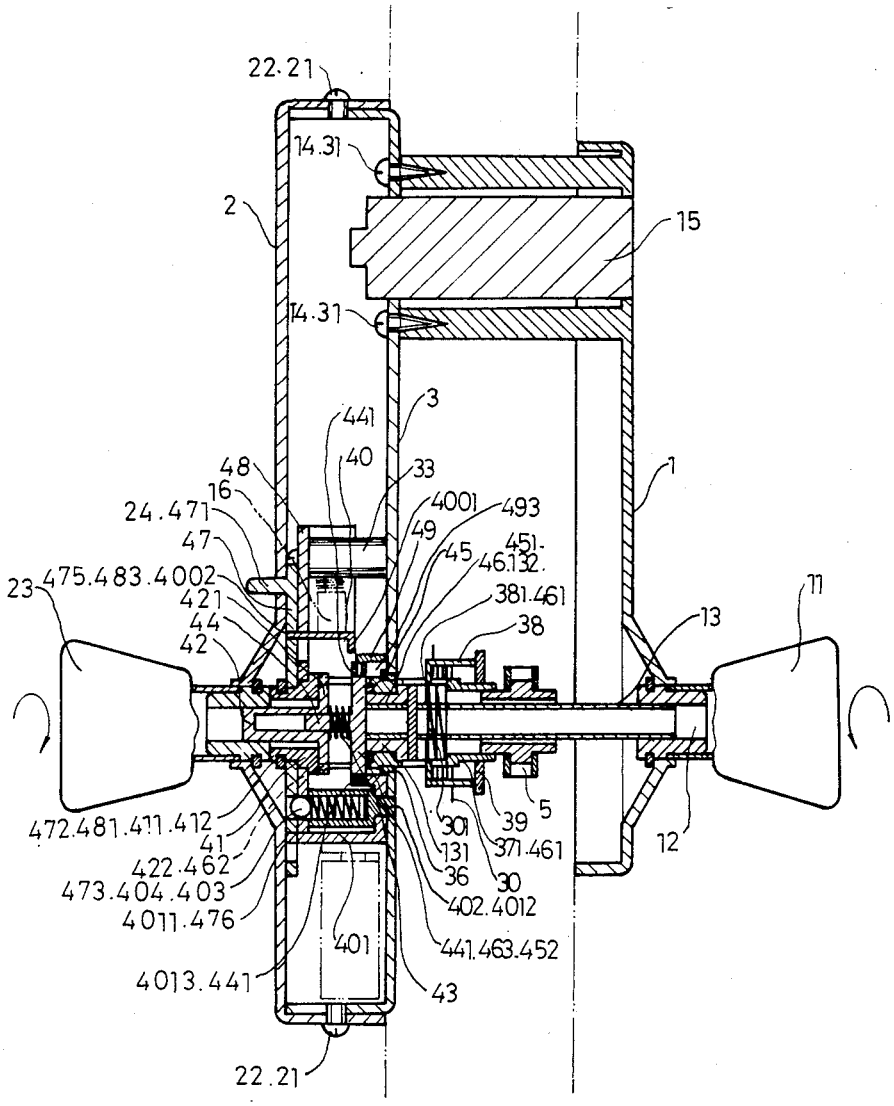
FIG. 4 is another cross-sectional view of this invention.

Inside cover 2 is to cover base plate 3 from the inside of a door, fixed together with base plate 3 with screw 21 screwed in screw hole 22, and includes turning knob 23 which has a square shaft hole as shown in figure 3 for square shaft 42 to combine with. In addition, inside cover 2 is bored with curved slot 24 for pin 471 of control plate 47 to protrude out of inside cover 2 so that control plate 47 may be manually moved by pushing left or right said pin 471.

Base plate 3 is fixed on the inside of the door, and lid 48 is fixed with base plate 3 with screws 34 screwed in posts 33; moving parts 4 are to be combined together inside lid 48. In addition, base plate 3 has a round hole 35 for ring 36 to fit in; in the inner empty circle of ring 36 fits engaging base 46 which can turn around therein.

In the inner circle of engaging base 46 and turning around therein is a square shaft 13 whose end is riveted with head 131 which has smaller-diameter part 132; smaller-diameter part has two straight sides 133 engaging with engaging disc 45. When knob 11 is turned with square shaft 13 inserted in shaft hole 12, engaging disc 45 is to be turned accordingly. Square shaft 13 has moving ring 37, returning ring 38, stable plate 39, returning spring 30 and spring 301 combined together through around itself.

Moving ring 37 has two ears 371 protruding outward and said ears 371 stick in two engaging grooves 461 of engaging base 46. From the inner wall of moving ring 37 protrude inward two keys 372, which stick in moving notches 51 of dead bolt 5 so that dead bolt 5 may be moved when engaging base 46 is turned.

Returning ring 38 has two keys 381 symmetrically protruding inward which stick in engaging grooves 461 of engaging base 46 and turning of engaging base 46 can cause returning ring 38 to turn. Returning ring 38 also has four feet 382 around which returning spring 30 stays inside, and one end of sid spring 30 hooks at shaft post 14 and the other is to be hooked with and pushed by one of said feet 382 making said spring 30 to contract; when the pressure on said spring 30 disappears said spring 30 automatically lengthens to let engaging base 46 return to its place.

Moving parts 4 include fixing ring 41, square shaft 42, spring 43, moving base 44, engaging disc 45, engaging base 46, control plate 47, lid 48, rail 49, blocking plate 40 and homing ring 401.

Fixing ring 41 fixes in round hole 481 of lid 48 with its neck, which control plate 47 fixes in and is stabilized at its place by C-shaped ring 412 stuck around ring groove 411 of said ring 41. Square shaft 42 inserts through said ring 41 and can turn therein, and also engages in the square shaft hole of knob 23. In addition, square shaft 42 has a round hole in its center as shown in FIG. 3 for spring 43 and moving base 44 to stay in, and round disc 421 which has four holes 422 receiving petals 462 of egaging base 46 so that turning knob 23 may activate square shaft 42 to turn engaging base 46.

Spring 43, moving base 44 and engaging disc 45 are placed between hole 422 of square shaft 42 and petals 462 of engaging base 46; moving base 44 is always pressed by spring 43 so that cross rod 441 of moving base 44 always sticks in grooves 463 of engaging base 46. But the upper and lower part of cross rod 441 are longer than and extend out of the outside wall of engaging base 46, and the upper part of cross rod 441 is blocked by blocking tip 4001 of blocking plate 40 so that moving base 44 cannot move to reach the bottom of grooves 463 of engaging base 46.

Between moving base 44 and engaging base 46 is engaging disc 45 which engages with smaller-diameter part 132 of square shaft 13 by means of its long oval hole 451. In addition, engaging disc 45 has four grooves 452 for cross rod 441 to stick in.

Four petals 462 at the left side of engaging base 46 fit in holes 422 of square shaft 42, and spring 43, moving base 44 and engaging disc 45 are placed between said base 46 and said shaft 42. Engaging grooves 461 at the right side of said base 46 are for ears 371 of moving ring 37 and keys 381 of returning ring 38 to fit in.

Control plate 47 can turn by fixing with the neck of fixing ring 41 with round hole 472, has pin 471 protruding out of curved slot 24 of inside cover 2, and two holes 473 for steel ball 404 to go in so as to keep control plate 47 at the right or the left position. At the upper side of round hole 472 is bored sector-shaped hole 474 and at the lower side oval hole 476 and tapered slot 475 extending out of sector-shaped hole 474 can be stuck in by ear 4002 of blocking plate 40 so that when control plate 47 is moved said ear 4002 can be moved from the bottom of sector-shaped hole 474 to tapered slot 475. Oval hole 476 is to be stuck in by round post 4011 of homing ring 401, which can turn as control plate 47 is turned.

Lid 48 is fixed on base plate 3 with four screws 34 screwed in posts 33, has round hole 481 facing correctly round hole 35 of base plate 3 and two small round holes 482 facing correctly two small round holes 302 of base plate 3 for fixing magnetic coil 16. In addition, lid 48 has window 483 for ear 4002 of blocking plate 40 to protrude and to move, and round hole 484 for round post 4011 of homing ring 401 to protrude out.

Next, as FIGS. 2, 13, 14, 15 show, rail 49 is combined with base plate 3 with two round holes 491 being inserted by posts 303 and is pushed as near base plate 3 as possible by springs 492; rail 49 also has notch 493 for the upper part of cross rod 441 of moving base 44 to pass by, but the passing by of said upper part of cross rod 441 is controlled by blocking tip 4001 of blocking plate 40. Rail 49 has one inclined way 494 starting from notch 493 to the right and to the left. When blocking tip 4001 does not block up notch 493, the round upper part of the cross rod 441 moves in notch 493 and cross rod 441 sticks in grooves 452 of engaging disc 45 as moving base 44 is pressed and moved forward by the pushing of spring 43. Then if knob 11 or 23 is turned, said round upper part of cross rod 441 moves downward along the inside of inclined way 494 and slips off at notch 495 of inclined way 494. While cross rod 441 is being moved rail 49 compresses springs 492 because of the inclination of inclined way 494. After the round upper part of the cross rod 441 has slipped off notch 495, rail 49 is to be moved back to its place pushed by springs 492 and the round upper part of cross rod 441 retreats to the outside of rail 49. Then if knob 11 or 23 is released, moving base 44 moves back pushed by engaging base 46 and the round upper part of cross rod 441 moves up along the outside of inclined way 494 to notch 493. But blocking tip 4001 of blocking plate 40 then moves down again to block up notch 493, so the round upper part of cross rod 441 cannot move in there.

Blocking plate 40 is supported at post 304 of base plate 3 with two ear holes 4003 and blocking tip 4001 set under said plate 40 can block up notch 493 of rail 49. In addition, ear 4002 extending out of the side of said plate 40 protrudes through window 483 of lid 48 and sector-shaped hole 474 of control plate 47. Blocking plate 40 itself can either be pulled by magnetic coil 16 or be moved by control plate 47 to raise up blocking tip 4001.

Homing ring 401 is fixed on base plate 3 with pin 402 inserted through round hole 4012 of said ring 401, and can turn around with pin 402 acting as an axle; in addition, homing ring 401 has round post 4011 to protrude through oval hole 476 of control plate 47. Pin 402 has a round hole to put in spring 403 and steel ball 404 which pushes against small round hole 473 of control plate 47. On the body of homing ring 401 is a rising-up wall 4013 which presses against the lower part of cross rod 441 of moving base 44 and can press laterally said lower part of cross rod 441 when returning ring 401 turns around. Moving base 44 is then moved laterally so that the upper part of cross rod 441 may move from the inside of notch 493 to the outside of notch 493 of rail 49.

Dead bolt 5 is all the same as the conventional one, except the shaft to be moved by the knob is made of round tube, and the round tube has two moving notches 51 for keys 372 of moving ring 37 to match in and to move it.

Now various actions and the usage of this invention will be described.

A. When pin 471 of control plate 47 is moved to the position of "closed ";

ear 4002 of blocking plate 40 is stuck at the bottom of sector-shaped hole 474, so blocking tip 4001 is stuck in notch 493 of rail 49 obstructing cross rod 441 of moving base 44 from moving in so that cross rod 441 does not engage with grooves 452 of engaging disc 45.

1. If knob 23 of inside cover 2 is turned around, square shaft 42 turns around engaging base 46, which turns moving ring 37, which in order turns the round tube of dead bolt 5 to cause dead bolt tip 52 to be pulled back. Then this lock is opened.

Figure 5:
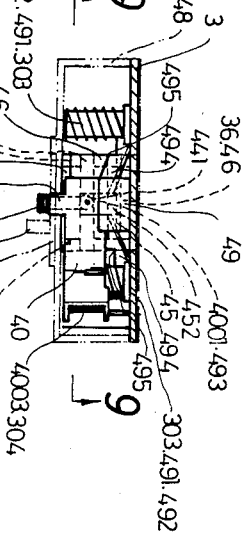
FIG. 5 is an actional view 1 of the moving base, the blocking plate and the rail in this invention.
Figure 9:
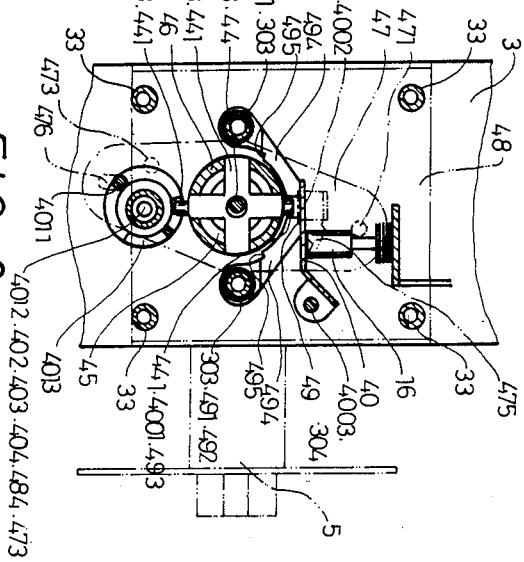
FIG. 9 is a cross-sectional view of 9—9 line on FIG. 5.

2. If knob 11 of outside cover 1 is turned around, square shaft 13 is turned causing engaging disc 45 to turn as well, but the outside of notch 493 of rail 49 is blocked up by blocking tip 4001 of blocking plate 40 as FIGS. 5, 9 show, so engaging disc 45 cannot engage with moving base 44, so engaging disc 45 makes idle turning so that engaging base 46 cannot be turned to pull back the dead bolt tip. Then this lock is still locked.

Figure 6:
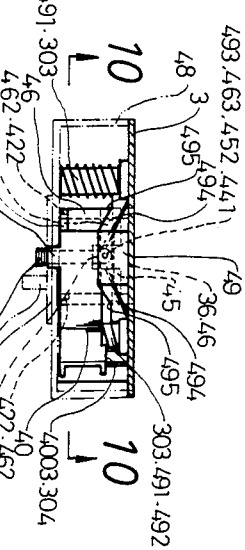
FIG. 6 is an actional view 2 of the moving base, the blocking plate and the rail in this invention.
Figure 10:
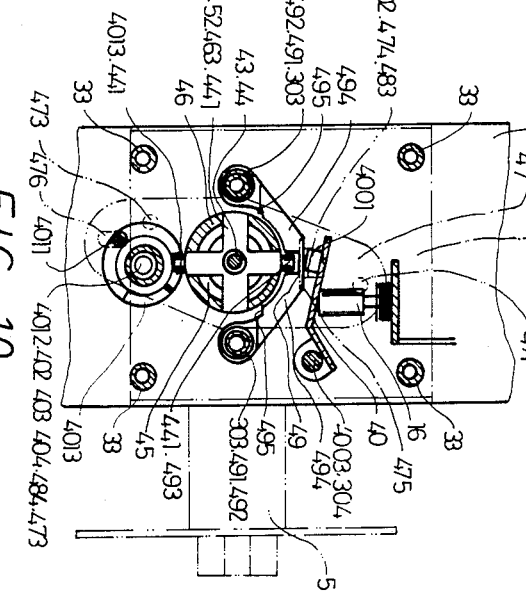
FIG. 10 is a cross-sectional view of 10—10 line on FIG. 6.
Figure 13:
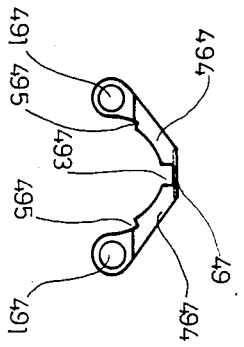
FIG. 13 is an upside view of the rail in this invention.
Figure 14:
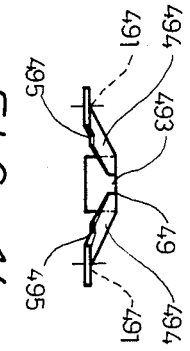
FIG. 14 is a front view of the rail in this invention.
Figure 15:
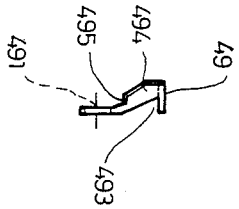
FIG. 15 is a side view of the rail in this invention.

3. After sensor 15 has examined the correct card inserted in and found the coded number on it satisfactory, it supplies power to magnetic coil 16 which works to produce magnetic force to pull blocking plate 40 for a certain period of time previously set so shown in FIGS. 6, 10. Then blocking tip 4001 slips off notch 493 of rail 49, and spring 43 pushes moving base 44 to move forward passing by notch 493 and entering the inside of rail 49 so that cross rod 441 is engaged in grooves 452 of engaging disc 45.

Under this position, turning knob 11 causes engaging disc 45 to turn moving base 44, which in turn turns engaging base 46; then engaging base 46 as described in item 1 activates to pull back the dead bolt tip 52 opening this lock.

Remarks. The power for magnetic coil 16 will be shut off after the pre-arranged period of time, so if the lock is not opened within the limited period of time with the card inserted in, the action of inserting the card should be repeated to open the lock.

4. As described in item 3, after the lock has been opened by inserting the correct card in the sensor 15 and turning knob 11, then the power to magnetic coil will be cut off. Then blocking tip 4001 of blocking plate 40 will go down to fill in notch 493 of rail 49, and the round upper part of cross rod 441 of moving base 44 has slided down along the inside of inclined way 494 of rail 49 by the turning of knob 11, and will slip off notch 495 of inclined way 494, but will slide up along the outside of inclined way 494 (as moving base 44 itself turns back to its place turned by engaging base 46 which also turns back to its place). Then notch 493 has already been filled in by blocking tip 4001 of blocking plate 40 which has gone down, so the round upper part of cross rod 441 of moving base 44 can no longer move inside notch 493. Now this lock is in the locked state.

In short, inserting the correct card can afford knob 11 to turn only one time to unlock the lock, and the lock is to be automatically locked after the door is closed.

B. When pin 471 of control plate is moved to the position of "open", ear 4002 of blocking plate 40 gradually moves from sector-shaped hole 474 up to slot 475 as shown in figure 12, so blocking tip 4001 of blocking plate 40 no longer hampers cross rod 441 of moving base 44 to move in rail 49, in other words, cross rod 441 comes to stick in grooves 452 so that moving base 44, engaging disc 45 and engaging base 46 are united together as one unit.

Under this position, 1. turning knob 23 will open the lock just the same as the movement described in item 1 of A;

2. turning knob 11 will open the lock causing square shaft 13, engaging disc 45, moving base 44, engaging base 46, moving ring 37 and dead bolt 5 to work in order.

So the lock can repeatedly and freely be opened by turning either the inside or the outside knob under this condition without the necessity of using the card.

C. The principle of automatic returning to place for the dead bolt tip 52 and engaging base 46 is as follows.

Engaging grooves 461 of engaging base 46 are stuck in by keys 381 of returning ring 38 inside which spring 30 stays with one end hooked on shaft post 14 and the other end on foot 382 of said ring 38, so once engaging base 46 is turned, said ring 38 contracts said spring 30; but on the contrary, if the force of turning said base 46 disappears, spring 30 can automatically lengthen to cause said base 46 to run back to its place, and the lock is to be locked as the dead bolt tip 52 extends out then.

D. In case control plate 47 has been moved from the position of "open" to that of "close" again, turning knob 11 could open the lock without homing ring 401 because the round part of cross rod 441 moves inside notch 493 of rail 49 as described in item B, and said cross rod 441 still sticks in grooves 452 of engaging disc 45, then this lock is unsafe. Therefore, this invention adds this part "homing ring" 401 to keep this lock safe.

Moving control plate 47 turns homing ring 401 through oval hole 476, and said ring 401 turns depending on pin 402. As this occurs, rising wall 4013 of said ring 401 keeps touching the lower rod of cross rod 441 of moving base 44. In other words, cross rod 441 climbs up passing a high point of said wall 4013 and slides down the other side of said wall 4013, so said base 44 can retreat after passing the high point. And at the same time ear 4002 of blocking plate 40 has already entered sector-shaped hole 474, and blocking tip 4001 quickly falls down the opening between the upper rod of cross rod 441 and rail 49 sticking in notch 493 to obstruct said upper rod of cross rod 441 from entering there. Therefore, knob 11 can not open the lock after control plate 47 has been moved to the position of "closed" again.

In short, this invention has the following advantage.

1. Outside knob 11 can open this lock only one time with the correct card inserted in this lock. The correct card should be taken out and inserted in the lock again for repeating the opening action by outside knob 11.

2. This lock can be opened from the inside of the door freely without the correct card.

3. This lock becomes no more controllable and can be opened by turning inside knob 23 or outside knob 11 for the convenience of entering or exiting if the control plate 47 has been moved to the position of "open".

What is claimed is:

1. An electronic lock apparatus for a door or the like having an inside and an outside comprising:

a movable dead bolt;

an outside cover on the outside of the door including an outside turning knob and an outside square shaft extending inwardly of the door from said outside knob and turning therewith;

an engaging disc which is engaged by said outside square shaft and which turns therewith;

a base plate on the inside of the door which is coupled to said outside cover such that said base plate and said outside cover are held in place on the door;

an inside cover which is attached to said base plate, said inside cover including a cover slot, an inside turning knob, and an inside square shaft extending inwardly toward said outside square shaft from said inside knob and turning therewith;

an engaging base which is coupled to said dead bolt to move said dead bolt when said engaging base is rotated, said engaging base also being engaged with said inside square shaft to be rotated thereby and being disposed adjacent said engaging disc of said outside shaft;

a moving base which engages said engaging base and which is movable into and out of engagement with said engaging disc;

an urging means for resiliently urging said moving base into engagement with said engaging disc;

a control means provided between said inside cover and said base plate and including a portion extending through the cover slot provided in said inside cover and being movable between an open setting and a closed setting, said control means allowing said urging means to move said moving base into engagement with said engaging disc when said portion of said control means is in the open setting and said control means moving said moving base out of engagement with said engaging disc when said portion of said control means is in the closed setting whereby said inside knob is always capable of rotating said engaging base and said outside knob is capable of rotating said engaging base when said portion of said control means is in the open setting but is not ordinarily capable of rotating said engaging base when said portion of said control means is in the closed setting; and a sensor located adjacent said outside cover which senses a predetermined correct enabling mechanism and which actuates a sensor moving means for allowing said urging means to move said moving base temporarily into engagement with said engaging disc such that said outside knob is temporarily capable of rotating said engaging base when said portion of said control means is in the closed setting.

2. An electronic lock apparatus as claimed in claim 1 wherein said moving base includes a projection perpendicular to an axis of movement;

wherein said control means includes a rail having a notch therein in which said projection of said moving base is receivable to allow said urging means to urge said moving base into engagement with said engaging disc, and a blocking plate having a tip which is movable between a blocking position to which said tip is normally biased into position to block entry of said projection into said notch by said urging means to a non-blocking position where said tip is not blocked; and wherein said sensor moving means temporarily moves said tip of said blocking plate to the non-blocking position.

3. An electronic lock apparatus as claimed in claim 2 wherein said control means further includes: (a) a mounting means for mounting said rail for movement between a normal position to which said rail is normally biased and a reset position, (b) a camming surface on said rail which causes the turning of said projection on said moving base by said outside handle after said projection passes through said notch to move said rail from the normal position to the reset position, and (c) a second notch provided in said camming surface of said rail which allows said projection therethrough as said rail reaches the reset position such that said rail returns to the normal position where said projection must pass through said notch before enabling said outside handle.

4. An apparatus lock apparatus as claimed in claim 3 wherein said control means includes a tip moving means for moving said tip of said blocking plate to the non-blocking position as said portion of said control means is moved from the closed setting to the open setting such that said projection of said moving base passes through said notch of said rail and said moving base engages said engaging disc.

5. An electronic lock apparatus as claimed in claim 4 wherein said control means further includes a base moving means for moving said projection of said moving base back through said notch of said rail and said moving base out of engagement with said engaging disc and for subsequently moving said tip of said blocking plate back to the blocking position as said portion of said control means is moved from the open setting to the closed setting.

6. An electronic lock apparatus as claimed in claim 1 wherein said engaging disc is located inside of said engaging base and is freely turnable therein except when coupled with said moving base such that said outside handle which is directly connected to said engaging disc by said outside square shaft is similarly freely turnable except when said engaging base is coupled with said moving base.

7. An electronic lock apparatus as claimed in claim 1 wherein said inside square shaft includes a shaft disc having peripheral holes and said engaging base includes petals extending therefrom which said petals are received in said holes of said shaft disc to engage said inside square shaft with said engaging base.

8. An electronic lock apparatus as claimed in claim 5 wherein said portion of said control means is a pin which extends through said slot in said inside cover; wherein said control means includes a control plate from which said pin extends and which control plate is mounted for rotation about said inside square shaft; and wherein said slot in said inside cover is curved about said inside square shaft.

9. An electrode lock apparatus as claimed in claim 1 and further including a lid provided between said inside cover and said base plate, an attaching means for attaching said lid to said base plate, and a mounting means for rotatably mounting said inside square shaft, said moving base and said engaging base between said lid and said base plate.

10. An electronic lock apparatus as claimed in claim 9 wherein said control means includes a magnetic coil which is mounted between said lid and said base plate.

11. An electronic lock apparatus as claimed in claim 10 wherein said blocking plate is mounted for rotation on said base plate adjacent said magnetic coil.

12. An electronic lock apparatus as claimed in claim 11 wherein said control means includes a sector-shaped hole and wherein said blocking plate further includes a blocking ear which protrudes through said sector-shaped hole.

13. An electronic lock apparatus as claimed in claim 8 wherein said base moving means includes: (a) a homing ring mounted for rotation on said base plate, said homing ring including a port extending from an off-center position into a slot provided in said control plate such that rotation of said control plate also causes rotation of said homing ring, and a ring camming surface having a central peak; and (b) a second projection from said moving base which engages said ring camming surface; and wherein said mounting means mounts said moving base to said base plate such that rotation of said control plate causes said ring camming surface of said homing ring to press against said second projection of said moving base to move said moving base.

14. An electronic lock apparatus as claimed in claim 1 wherein said dead bolt includes a bolt tip and round tube through which said outside square shaft extends which said outside shaft is rotatable by rotation of said outside knob to move the bolt tip, said round tube including tube notches adjacent said base plate; wherein said moving base includes moving grooves extending in an opposite direction from said petals; and wherein said engaging base is coupled to said dead bolt by a bolt coupling means, said bolt coupling means including a moving ring provided about said outside square shaft and having outwardly extending ears which engage in said moving grooves of said engaging base and inwardly extending keys which engage said tube notches of said round tube.

15. An electronic lock apparatus for a door or the like having an inside and an outside comprising:

a movable dead bolt;

an outside cover mounted on the outside of the door including an outside turning knob, and an outside square shaft extending inwardly of the door from said outside knob and turning therewith;

an inside cover mounted on the inside of the door including a curved cover slot, a base plate mounted against the door, a lid attached to said base plate, an inside turning knob, and an inside square shaft extending inwardly through a hole in said lid toward said outside square shaft from said inside knob and turning therewith, said inside square shaft including a distal end located between said lid and said base plate, an axially extending hole in said distal end, and a shaft disc at said distal end with four peripheral holes therein;

an engaging base extending through said base plate and mounted for rotation therein, said engaging base including four petals extending axially which are received in respective said peripheral holes of said shaft disc with said petals defining four petal grooves therebetween and a central petal bore, and a bolt coupling means for coupling said engaging base with said dead bolt such that said dead bolt is moved when said engaging base is rotated;

a moving base disposed in said central petal bore of said engaging base and including four rods forming across which said rods are received in respective said petal grooves of said engaging base, two of said rods ending in posts which extend upwardly and downwardly respectively past said adjacent petals, and a round horizontal rod extending perpendicular to said four rods into said axially extending hole in said distal end of said inside square shaft;

a spring located in said axially extending hole of said distal end of said inside square shaft against which said round horizontal rod of said moving base bears such that said spring urges said moving base toward said engaging base;

an engaging disc located in said central petal bore of said engaging base between said engaging base and said moving base, said engaging disc being connected to said outside square shaft and turing therewith free of said engaging base, said engaging disc including four disc grooves facing said four rods of said moving base and selectively receiving said said four rods therein so that said moving base engages said engaging disc;

a control means for controlling the movement of said dead bolt by said outside turning knob including:

(a) a control plate mounted on said lid adjacent said inside cover for rotation about the lid hole, said control plate including a pin protruding through said curved cover slot in said inside cover so as to be movable between a open setting and a closed setting, a sector-shaped hole above said lid hole, and an oval hole below said lid hole, (b) a rail having a notch therein, (c) a rail mounting means for movably mounting said rail to said base plate for movement between a normal position and a reset position such that in the normal position said notch of said rail allows passage of said upwardly extending post of said moving base therethrough, (d) a biasing means for biasing said rail toward the normal position, (e) a blocking plate having a tip and an ear, (f) a block mounting means for mounting said blocking plate to said base plate such that said tip is movable between (i) a blocking position to which said tip is normally biased to block passage of said upwardly extending post of said moving base through said notch of said rail when said rail is in the normal position and thus to prevent engagement of said engaging disc by said moving base and (ii) a non-blocking position where passage of said upwardly extending post is not blocked and thus said engaging disc is engaged by said moving base, and such that said ear extends through said hole in said lid and is located in said sector-shaped hole of said control plate, (g) a base moving means for moving said upwardly extending post of said moving base through said notch of said rail when said rail is in the normal position and thus moving all of said rods of said moving base out of engagement with said disc grooves of said engaging disc, and for subsequently moving said tip of said blocking plate back to the blocking position as said pin of said control plate is moved from the open setting to the closed setting, said base moving means including (i) a homing ring mounted for rotation on said base plate, said homing ring including a homing post extending from an off-center position through said lid and into said oval hole of said control plate such that rotation of said control plate also causes rotation of said homing ring, (ii) a ring camming surface having a central peak on said homing ring which is engaged by said downwardly extending post of said moving base such that rotation of said homing ring by said control plate causes said camming surface to move said downwardly extending post and hence said moving base against the bias of said spring whereby said upwardly extending post is moved back through said notch of said rail.

16. An electronic lock apparatus as claimed in claim 15 wherein said dead bolt includes a bolt tip and a round tube through which said outside square shaft extends and which said outside shaft is rotatable by rotation of said outside knob to move the bolt tip, said round tube including tube notches adjacent said base plate; wherein said moving base includes moving grooves extending in an opposite direction from said petals; and wherein said bolt coupling means includes a moving ring provided about said outside square shaft and having outwardly extending ears which engage in said moving grooves of said engaging base and inwardly extending keys which engage said tube notches of said round tube.

17. An electronic lock apparatus as claimed in claim 15 wherein said control plate includes a tapered slot adjacent said sector-shaped slot such that said ear of said blocking plate is moved in said tapered slot to move said top of said blocking plate to the non-blocking position as said control plate is moved from the closed setting to the open setting.

* * * * *